US006298507B1

(12) United States Patent
Clyburn

(10) Patent No.: US 6,298,507 B1
(45) Date of Patent: Oct. 9, 2001

(54) HIP GRIP TABLE ATTACHMENT FOR OPERATING TABLES

(76) Inventor: Terry A. Clyburn, 6410 Fannin, No. 1100, Houston, TX (US) 77030

( * ) Notice: Subject to any disclaimer, the term of this patent is extended or adjusted under 35 U.S.C. 154(b) by 0 days.

(21) Appl. No.: 09/514,242

(22) Filed: Feb. 28, 2000

(51) Int. Cl.[7] ..... A61G 13/00

(52) U.S. Cl. ..... 5/623; 5/624; 5/507.1; 248/445

(58) Field of Search ..... 5/623, 621, 624, 5/507.1, 503.1; 248/445; 128/869, 846

(56) References Cited

U.S. PATENT DOCUMENTS 372,288 * 11/1887 Bailey ..... 5/507.1
1,134,720 * 4/1915 Bradley ..... 5/623
2,119,325 * 5/1938 Goodhart ..... 5/624
3,020,909 * 2/1962 Stevens ..... 5/623
4,113,218 * 9/1978 Linder ..... 5/507.1
4,583,725 * 4/1986 Arnold ..... 5/421
4,686,727 * 8/1987 Wilkinson ..... 5/503.1
5,152,486 * 10/1992 Kabanek et al. ..... 5/507.1
5,362,021 * 11/1994 Phillips ..... 5/507.1
5,390,383 * 2/1995 Carn ..... 5/621

* cited by examiner

*Primary Examiner*—Alexander Grosz
(74) *Attorney, Agent, or Firm*—Kenneth A. Roddy

(57) ABSTRACT

A hip grip table attachment apparatus for positioning and retaining a patient in a position lying on one side during hip or pelvic surgery is disclosed. The hip grip table attachment apparatus attaches to an operating table and has a removable top platform attachment for supporting surgical instruments that extends over and also protects the upper body of a patient lying on one side, an arm support attachment that supports an arm of the patient to prevent rolling, and pelvic positioner attachments that position and retain and the patient's lower pelvic region.

18 Claims, 3 Drawing Sheets

HIP GRIP TABLE ATTACHMENT FOR OPERATING TABLES

BACKGROUND OF THE INVENTION

1. Field of the Invention

This invention relates generally to surgical support devices for positioning and retaining a patient in a position lying on one side during hip or pelvic surgery. More particularly to a hip grip table apparatus that attaches to an operating table and has a removable top platform for supporting surgical instruments that extends over and protects the upper body of a patient lying on one side, an arm support attachment that supports an arm of the patient to prevent rolling, and pelvic positioner attachments that position and retain and the patient's lower pelvic region.

2. Brief Description of the Prior Art

Typically in surgical procedures such as hip and pelvic surgery, the patient is supported in a position lying on one side on an operating table, known as the lateral decubitis position, to facilitate a surgical procedure such as hip anthroplasty. In such procedures, it is extremely important to retain the patient in a fixed reference position relative to the operating table in order to achieve optimum fit and function of a hip prosthesis. In most instances the patient is under general anesthesia and cannot cooperate in maintaining the proper position.

A variety of patient support devices are known in the art for use in supporting a surgery patient in a position lying on one side (lateral decubitis position) on an operating table during hip or pelvic surgery. Some support devices, such as pelvic positioners or lateral positioners are mounted by clamps or other means onto opposed sides or side edges of the operating table. Conventional pelvic positioners have a pad supported at one end of an elongate rigid rod or arm that is clamped to the side edges or to rails or grooves on the opposed sides of the table by clamps. The opposed pads engage the anterior and posterior pelvic region of the patient and usually are in contact with the soft tissues in the pelvic region, resulting frequently in inadequate patient support and retention.

These conventional pelvic positioners or lateral positioners are not particularly suited to support the upper body of the patient who, in the lateral decubitis position, also has one shoulder on the table and the other shoulder extending vertically upward. The sedated or unconscious patient has no muscle control and often the upper body will tend to roll to one side or the other even the the pelvic region may be retained. The upper body is often supported by pillows. The arm on the elevated side of the body is heavy and difficult to properly position, and is often tied to one side of the table.

Another problem with conventional pelvic positioners and lateral positioners is that they are usually clamped to the side edges or rails on opposed sides of the operating table directly across from the hip area of the patient and directly in front of the operating surgeon with the clamps disposed at or below the surgeon's waist. Most conventional operating table clamps have a protruding knob or lever. Thus, the position of the clamps and protruding knob or lever produce a hazard and obstruction. The surgeon may come into bodily contact with the clamp or protruding knob or lever during the operation which can cause movement of the patient or injury to the surgeon, or can snag the surgeons clothing or gown during movement of the surgeon.

Still another problem with conventional pelvic positioners and lateral positioners is that the elongate rigid rod or arm that is clamped to the side edges or to rails on the opposed sides of the table and/or the pad supports that engage the anterior and posterior pelvic region of the patient may be made of metallic material which will often prevent good x-rays from being taken during the surgical procedure.

Another problem associated with hip and pelvic surgery wherein the patient is supported in a position lying on one side on an operating table is that the patient's face and upper body may be draped with a sheet but is otherwise unprotected. Thus, the patient may be injured by a surgical instrument being passed over his or her face or upper body, or by a surgical instrument that may be accidentally dropped during the surgical procedure.

There are several patents that disclose various work platforms, supports, and pelvic positioner apparatus that are attached to an operating table.

Linder, U.S. Pat. No. 4,113,218 discloses an adjustable frame assembly for attachment to the sides of a hospital operating table for supporting a removable surgical tray above the operating table and over the patient in a variety of positions for the convenience of personnel. The frame assembly consists of two upright supporting columns, one attached to each side of the operating table at an appropriate position. A horizontal bar is mounted between the upper ends of the upright supporting columns and extends across the operating table from one side to the other. A rectangular open frame member is supported by mechanical linkages to a pair of vertically-extending posts adjustably mounted, respectively, upon two slidable blocks carried by the horizontal bar. A removable surgical tray may be placed upon the open rectangular frame and clamped into position. The position of the surgical tray may be raised and lowered over the patient, may be moved about in a plane, or may be tilted or inclined as necessitated by the nature of the operation to increase the convenience, efficiency, and speed in the use of the surgical instruments placed upon the tray. There is no provision for positioning the patient, or for supporting an arm of the patient.

Lee, U.S. Pat. No. 4,180,254 discloses a surgical apparatus for locating a patient lying on his side to facilitate hip surgery which has a first platform to support the patient's lower hip, two posts upstanding from respectively opposite sides of this platform to engage the patient about the rear and front of his pelvis, a second platform extending from the first platform to support the patient's lower leg, at least one further post upstanding from the second platform, and a third platform connected to the further post above the second platform to support the patient's upper leg.

Evans, U.S. Pat. No. 4,390,011 discloses an adjustable surgical arm rest and instrument platform for supporting the arms and hands of a surgeon during a micro-surgical procedure, in which a supporting platform is provided with vertical and angular adjustment mechanisms which permit rapid adjustment of the platform before, during and after the operation. Two or more platforms may be used, and each platform can be adjusted independently of the other platforms. The angular adjustment of a platform can be performed independently of the vertical adjustment of the platform. Each mechanism is provided with a two part securing feature so that the platforms will not move accidentally.

Arnold, U.S. Pat. No. 4,583,725 discloses a patient support frame for use on an operating table during posterior lumbar laminectomy surgery that has a frame for attachment to the table and a pair of iliac crest supports slidably mounted on the frame. The iliac crest supports are adjustable to engage the iliacs, or hipbones, of the patient whereby the prone patient is supported so that the abdomen does not touch the table and is substantially without pressure thereon.

Mullin et al, U.S. Pat. No. 4,624,245 discloses a device for laterally displacing a femur from a hip socket which includes a mount for attachment to a stationary surface, such as a surgical table, a member for exerting pressure against the femur when the member is placed in a predetermined position in contact with the patient, and an assembly for moving the member relative to the mount. Movement of the member permits a sufficient amount of pressure to be exerted and maintained against the femur to laterally displace it from the hip socket.

Kurland, U.S. Pat. No. 4,653,482 discloses an upper-extremity traction tray attachment for operating tables which provides horizontal support form the arm, wrist and hand, or leg of a patient during surgical operations on those parts of the body. The tray comprises a perimetric rectangular metal frame having a pair of spaced-apart, downward-facing, L-shaped projections on each side. Any side of the frame may be secured to the side rail of a typical operating table by securing any of the projection pairs to the side rail on either side of a typical operating table with the common screw-type clamps which may be anchored at any point along the rail. A rigid rectangular sheet of material transparent to both X-rays and visible light spans the gap between the two longitudinal frame sections, a gap being left at either end between the lateral edges of the sheet and each lateral frame section. Traction pulley mounting arm and adjustable support leg assemblies or adjustable support leg assemblies may be mounted on either or both lateral frame sections. The sheet of transparent material has a lateral slot near one end. An elbow post may be slidably mounted at its base within the slot. There is no provision for positioning the patient, or for supporting an arm of the patient.

Tari et al, U.S. Pat. No. 4,858,903 discloses a hand surgery operating table connectable to a conventional main operating table and consisting of a forearm support that is rotatable in a horizontal plane as well as pivotable about a horizontal axis, and a base plate carrying a hand support; and up to seven flexible and tensionable arms secured at one end to the base plate and carrying finger-fixing thimbles at the other end. The tension of the arms can be adjusted to any desired extent so that they can either maintain their tensioned fixed position or they can be readily displaced therefrom without having to manipulate their tensioning mechanism.

Deluhery, U.S. Pat. No. 5,040,546 discloses a portable positioning device for supporting and holding a patient in a lateral decubitus position on the table of a densitometer or the like which includes a rigid back support having a vertical wall, a buttocks support having a vertical wall extending laterally at an angle relative to the vertical wall of the back support and a restraining means such as a flexible strap for holding the patient against these vertical walls.

Michelson, U.S. Pat. No. 5,135,210 discloses a surgical armboard attachment device that permits enhanced adjustability of a conventional surgical armboard. The attachment device permits adjustment of the armboard in three planes, and can be used as an adaptor to an existing armboard, or incorporated as a component of a new armboard structure.

Kabanek et al, U.S. Pat. No. 5,152,486 discloses a surgical assistance device used by members of the surgical staff as an arm or hand rest, instrument platform or sterile cloth support. The surgical assistance device has two rectangular shaped platforms covered by a covering capable of being sterilized. The platforms are attached so that the first platform runs parallel to the patient-supporting surface of the surgical table. The second platform is attached to the first platform and is oriented to the first platform at other than a 180-degree angle. The bottom surface of the first platform is attached to a mounting means for securing the surgical assistance device to the longitudinal support surface of a surgical table.

The present invention overcomes the above described problems and is distinguished over the prior art in general, and these patents in particular by a hip grip table attachment apparatus for positioning and retaining a patient in a position lying on one side during hip or pelvic surgery which is releasably attached to an operating table and has a removable top platform for supporting surgical instruments that extends over and protects the upper body of a patient lying on one side, an arm support attachment that supports an arm of the patient to prevent rolling, and pelvic positioner attachments that position and retain and the patient's lower pelvic region.

SUMMARY OF THE INVENTION

It is therefore an object of the present invention to provide a hip grip table attachment apparatus for positioning and retaining a patient in a position lying on one side during hip or pelvic surgery.

It is another object of this invention to provide a hip grip table attachment apparatus that is easily and quickly attached to and removed from a conventional operating table using conventional operating table clamps.

Another object of this invention is to provide a hip grip table attachment apparatus that is releasably attached to an operating table and has a removable top platform that extends over the upper body of a patient lying on one side and protects the patient's face and upper body from accidental injury, and also serves as a convenient work platform for supporting surgical instruments.

Another object of this invention is to provide a hip grip table attachment apparatus that is releasably attached to an operating table and has an adjustable horizontal arm support attachment that can be vertically and pivotally positioned adjacent to the upper body of a patient lying on one side to comfortably support the elevated arm of the patient, and also to prevent the patient's upper body from rolling over.

Another object of this invention is to provide a hip grip table attachment apparatus that is releasably attached to an operating table and has adjustable pelvic positioner attachments that engage and retain the lower pelvic region of a patient lying on one side in a proper position during hip or pelvic surgery.

Another object of this invention is to provide a hip grip table attachment apparatus for positioning and retaining a patient in a position lying on one side during hip or pelvic surgery that is clamped to a conventional operating table and has adjustable pelvic positioner attachments clamped thereto wherein the clamping elements are disposed a sufficient distance away from the surgeon performing a surgical procedure to prevent bodily contact therewith and snagging of the surgeons clothing during surgical procedures.

A further object of this invention is to provide a hip grip table attachment apparatus having pelvic positioner attachments that engage a patient's lower pelvic region and will not interfere with taking x-rays.

A still further object of this invention is to provide a hip grip table attachment apparatus for positioning and retaining a patient in a position lying on one side during hip or pelvic surgery which is simple in construction, inexpensive to manufacture, and rugged and reliable in operation.

Other objects of the invention will become apparent from time to time throughout the specification and claims as hereinafter related.

The above noted objects and other objects of the invention are accomplished by a hip grip table apparatus for positioning and retaining a patient in a position lying on one side during hip or pelvic surgery. The hip grip table attachment apparatus releasably attaches to an operating table and has a removable upper platform for supporting surgical instruments that extends over and protects the upper body of a patient lying on one side, a lower platform attachment that supports an arm of the patient to prevent rolling, and pelvic positioner attachments that position and retain and the patient's lower pelvic region.

DESCRIPTION OF THE PREFERRED EMBODIMENT

Figure 1:
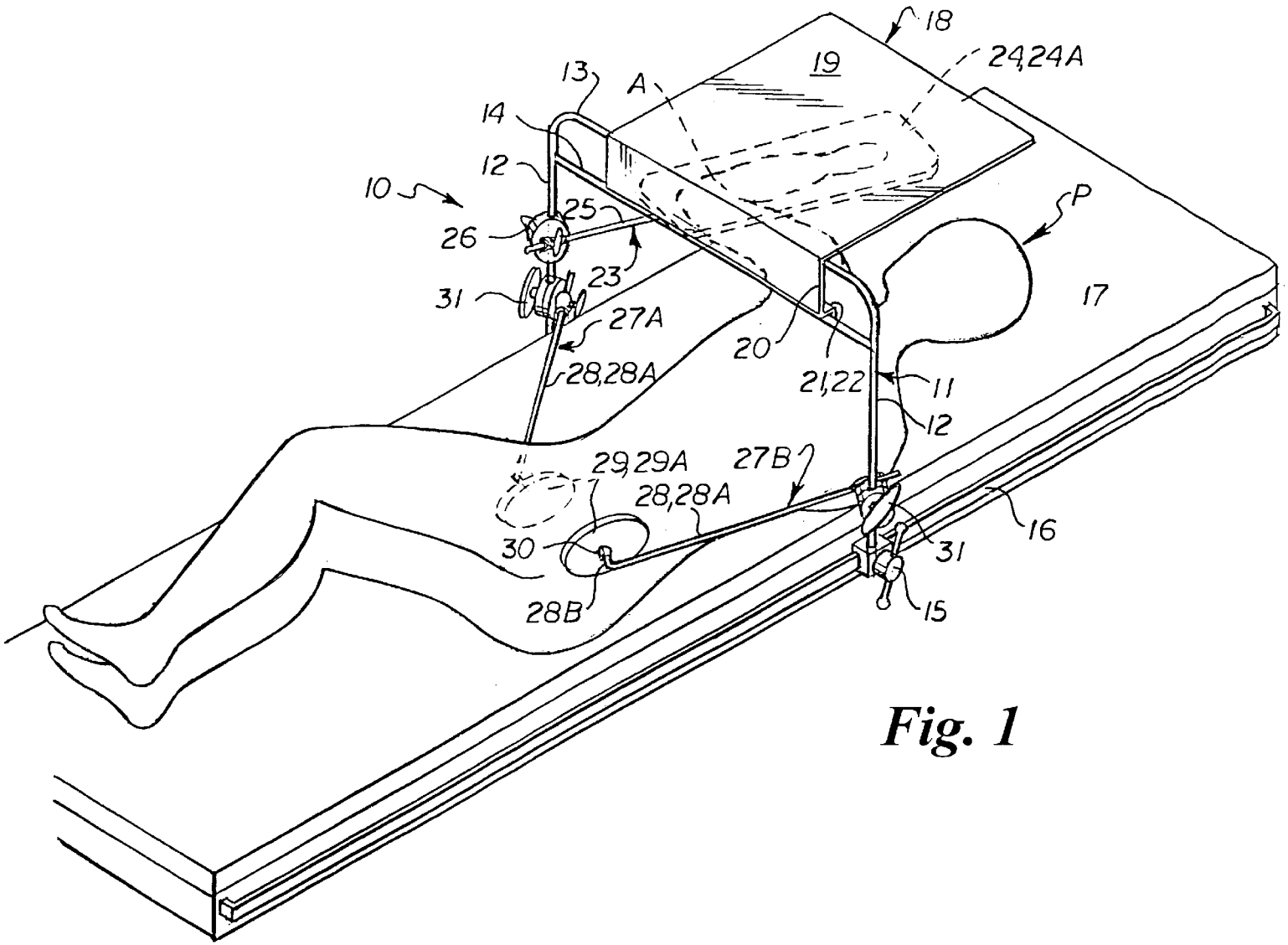
FIG. 1 is a perspective view of the hip grip table attachment apparatus in accordance with the present invention shown attached to an operating table and positioned relative to a patient lying on one side during hip or pelvic surgery.
Figure 2:
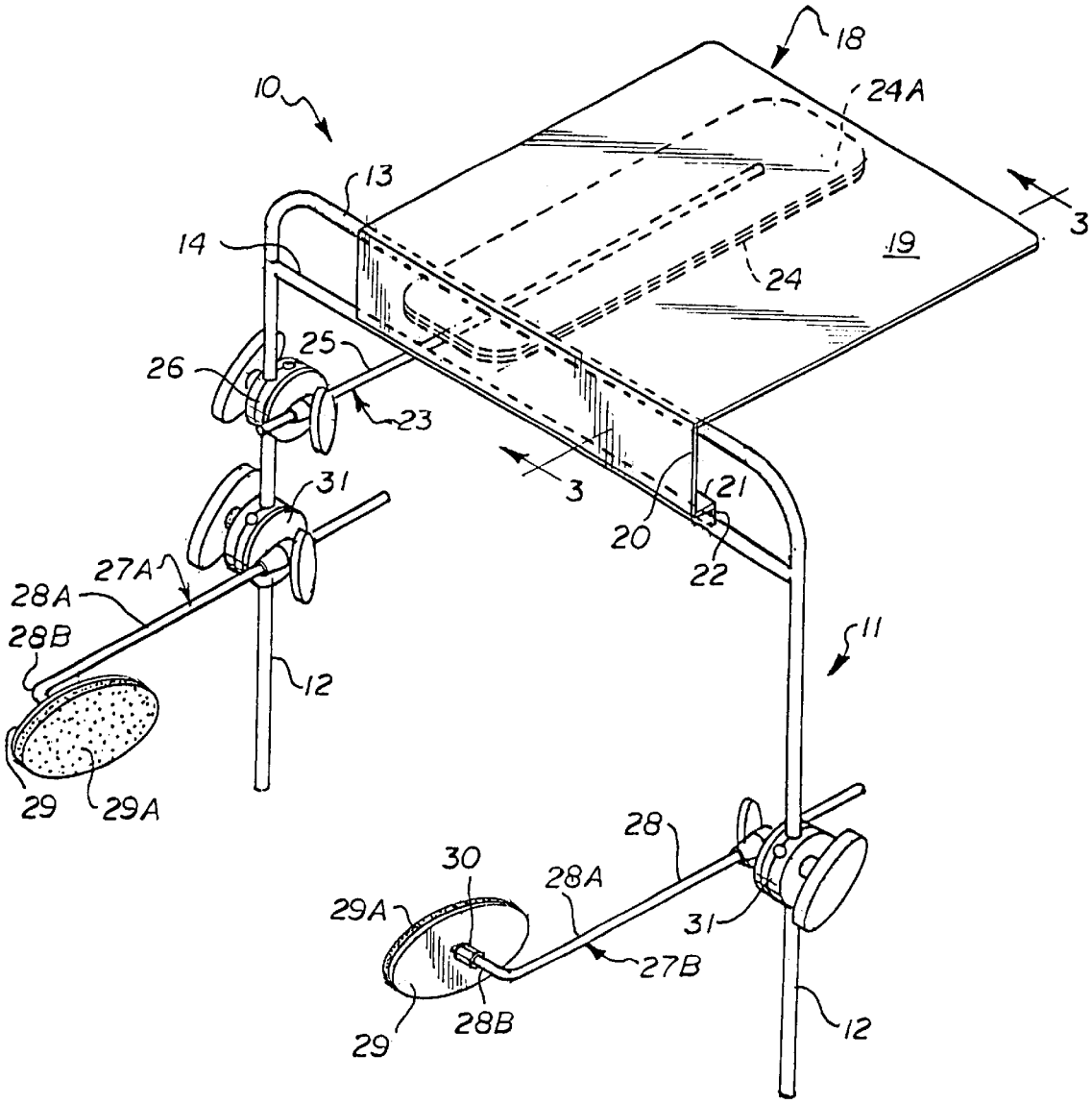
FIG. 2 is a perspective view of the hip grip table attachment apparatus shown in larger scale.

Referring to the drawings by numerals of reference, there is shown in FIGS. 1 and 2, a preferred hip grip table attachment apparatus 10. The hip grip table attachment apparatus 10 has an inverted, generally U-shaped frame 11 formed of bent tubing. The frame 11 has laterally opposed vertical legs 12, a contiguous horizontal top rail 13, and a lower horizontal rail 14 a short distance beneath the top rail secured at opposed ends between the legs in parallel vertically spaced relation to the top rail. As seen in FIG. 1, the lower portions of the legs 12 extend through respective conventional operating table clamps 15 which are slidably mounted on the existing rails 16 extending along the longitudinal sides of a conventional operating table 17. Although only one rail 16 and one clamp 15 is seen in FIG. 1, it should be understood that the second rail and second clamp is disposed on the opposite side of the operating table and would be identical to those shown.

A top platform 18 formed of rigid material is removably supported on the frame 11. The top platform 18 has a flat generally rectangular main portion 19 with a vertical end portion 20 that extends generally vertically downward from one end of the main portion. As shown from the side in cross section in FIG. 3, the lower end of the vertical end portion 20 has a short horizontal portion 21 that extends short distance inwardly in the direction of the main portion 19 and terminates in a short vertical portion 22.

Figure 3:
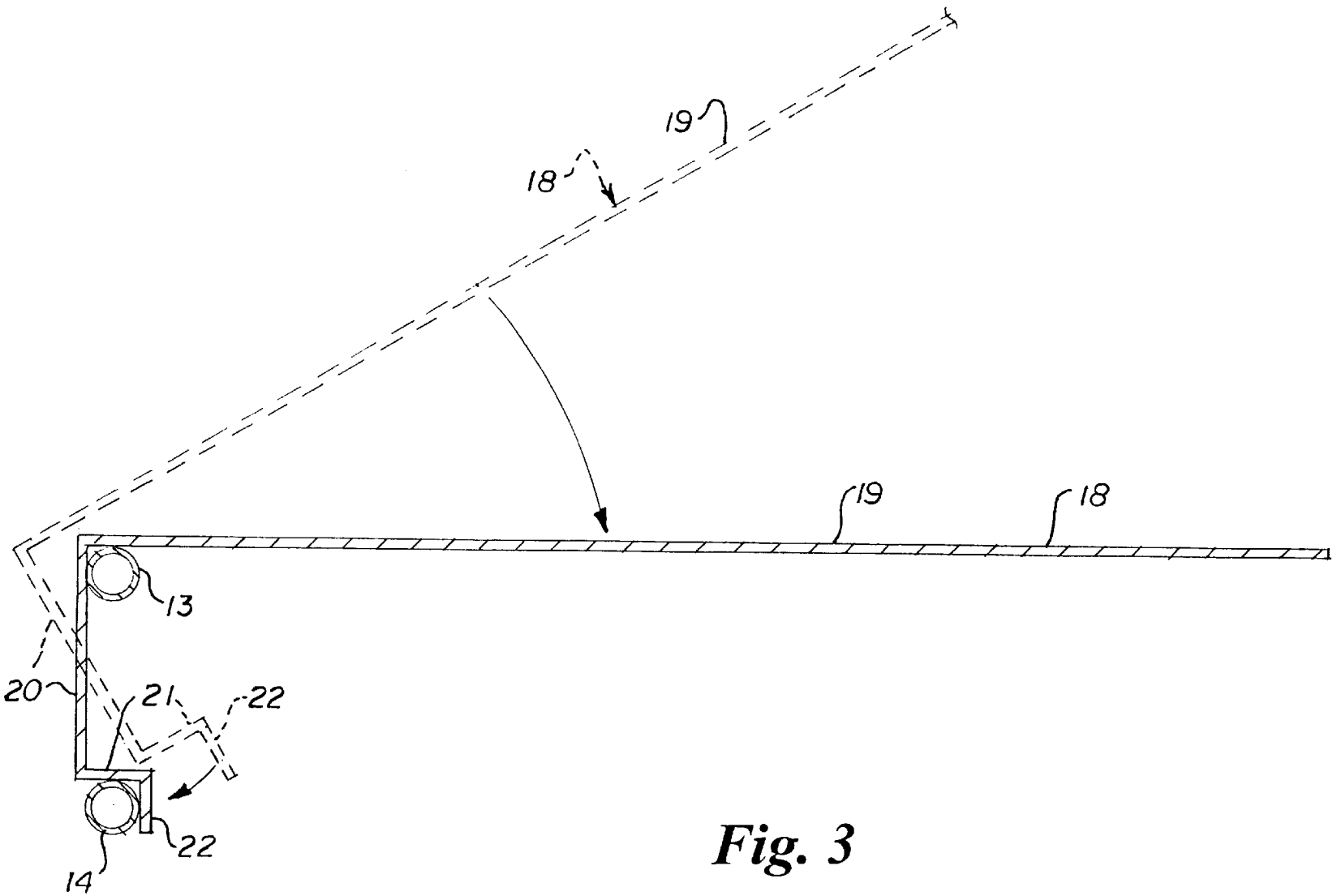
FIG. 3 is side cross sectional view through the frame of the hip grip table apparatus, showing the top platform attachment installed thereon.

As shown in FIG. 3, the top platform 18 is removably mounted on the frame by holding the main portion 19 upwardly and inserting the lower end of the vertical end portion 20 between the top rail 13 and lower rail 14 so that its short horizontal portion 21 and short vertical portion 22 engage the lower rail 14 and then lowering the main portion downwardly so that the underside of the vertical end portion 20 and main portion 19 rest on one side and top of the top rail 13. When properly positioned, the underside of the short horizontal portion 21 and short vertical portion 22 of the end portion 20 are engaged on the top and one side of the lower rail 14 and the underside of the vertical end portion 20 and main portion 19 are engaged on the top and one side and top of the top rail 13, as shown in FIG. 3. In the installed position, as see in FIGS. 1 and 2, the main portion 19 of the top platform 18 is cantilevered outwardly from the frame 11 and its weight maintains the vertical and horizontal surfaces engaged on the respective top and lower rails.

To remove the top platform 18, the steps described above are reversed. In a preferred embodiment, the top platform 18 has a width which is somewhat narrower than the distance between the legs 12 of the frame 11 so that the top platform may be centered or moved from side to side by sliding it laterally on the rails 13 and 14.

The frame 11 can be raised or lowered and rigidly secured to position the top platform 18 at a selected distance above and parallel to the top of the operating table 17 by loosening the operating table clamps 15 and moving the legs 12 vertically as required and then tightening the clamps, in a well known manner. The frame 11 and top platform 18 mounted thereon can also be positioned at a selected distance from either end of the operating table 17 by loosening the clamps 15 and moving the frame 11 longitudinally along the rails 16 as required and then tightening the clamps, in a well known manner.

Referring again to FIGS. 1 and 2, an arm support attachment 23 is adjustably connected to one of the legs 12 on one side of the frame 11. The arm support 23 has a generally rectangular plate 24 formed of rigid material covered by a pad 24A. An elongate tubular support rod 25 secured to the underside of the base plate extends outwardly from one end thereof. The outer end of the support rod 25 extends through a clamp 26 which is slidably mounted on one of the legs 12 of the frame 11. The arm support 23 can be raised or lowered and pivoted beneath and relative to the top platform 18, and secured at a selected distance above and parallel to the top of the operating table 17 by loosening the clamp 26 and moving it vertically along the leg 12 as required and then tightening the clamp. The distance of the arm support 23 relative to the leg 12 can adjusted by loosening the clamp 26 and moving the support rod 25 horizontally relative to the clamp 26 and leg 12 as required and then tightening the clamp. The lower platform 18 can also be pivoted in a horizontal plane relative to the vertical leg 12 supporting it by loosening the clamp 26 and rotating the clamp on the leg as required and then tightening the clamp. The clamp 26 is a commercially available clamp, and therefore is not shown and described in detail. A suitable clamp is manufactured by Matthews Studio Equipment, of Burbank, Calif.

A first pelvic positioner 27A is adjustably connected to one of the vertical legs 12 of the frame 11, and a second pelvic positioner 27B is adjustably connected to the other one of the vertical legs. Each pelvic positioner 27A,27B has a generally L-shaped tubular support rod 28 with an elongate portion 28A and a shorter portion 28B at one end that extends angularly outward from the elongate portion. A flat generally oval-shaped or kidney-shaped plate 29 formed of rigid material is mounted on the shorter portion 28B of each support rod 28 by a swivel connection 30 and covered by a pad 29A.

The end of the elongate portion 28A of each support rod 28 of the pelvic positioners 27A, 27B extend through clamps 31 which are mounted on the vertical legs 12 of the frame 11. The pelvic positioners 27A,27B extend horizontally outward a distance from the respective vertical legs 12 toward the foot end of the operating table with their padded plates 29, 29A facing inward in opposed facing relation. The clamps 31 are commercially available clamps, and therefore not shown and described in detail. A suitable clamp is manufactured by Matthews Studio Equipment, of Burbank, Calif.

Each pelvic positioner 27A,27B and the padded plates 29,29A at their outer ends can be raised or lowered independently and secured at a selected distance above and parallel to the top of the operating table 17 by loosening the clamps 31 and moving the support rods 28 vertically along the respective vertical legs 12, as required, and then tightening the clamps. Each pelvic positioner 27A,27B and the padded plates 29,29A at their outer ends can be positioned at a selected distance from the respective vertical legs 12 supporting them by loosening the clamps 31 and moving the support rods 28 horizontally relative to the clamps 31 and vertical legs 12, as required, and then tightening the clamps. Each pelvic positioner 27A,27B and the padded plates 29, 29A at their outer ends can also be pivoted in a vertical or horizontal plane relative to the respective vertical legs 12 supporting them by loosening the clamps 31 and rotating the clamps on the vertical legs as required and then tightening the clamp. In a preferred embodiment, the generally oval-shaped or kidney-shaped base plate 29 at the outer end of the pelvic positioners 27A,27B are sized and shaped so as not to obstruct x-rays taken of the hip area of the patient.

Referring again to FIG. 1, a patient P is shown supported in a position lying on one side on an operating table 17. The legs 12 of the frame 11 are placed into the clamps 15 mounted on the rails 16 on the opposed sides of the operating table. The top platform 18 is installed, as described above, and the frame is raised or lowered to place the main portion 19 of the top platform the desired distance above the elevated shoulder of the patient, and the frame top platform are positioned, as a unit, at the desired distance from the head end of the operating table, and the clamps 15 are then tightened.

The elongate support rod 25 of the arm support 23 is placed into the clamp 26 which is mounted on the vertical leg 12 at one side of the apparatus. The arm support 23 is raised or lowered and pivoted beneath the top platform 18, as described above, to the desired position to support the arm A of the patient in an elevated position, and the clamp 26 is then tightened. The arm A on the elevated side of the patient's body is then placed onto and supported by the padded plate 24,24A of the arm support 23.

The ends of the elongate portion 28A of each support rod 28 of the pelvic positioners 27A, 27B are placed into the clamps 31 that are mounted on the vertical legs 12 with their padded plates 29,29A disposed toward the foot end of the table and facing inward in opposed facing relation. Each pelvic positioner 27A,27B and the padded plates 29,29A at their outer ends are raised or lowered independently to the desired elevation and are pivoted inwardly, as described above, so that the opposed facing padded plates 29,29A are firmly engaged on the anterior and posterior pelvic region of the patient, and the clamps 31 are then tightened. In a preferred embodiment, the padded base plate 29 at the outer end of the anterior pelvic positioner 27A is firmly biased against the patient's pubis and the padded base plate of the posterior pelvic positioner 27B is firmly engaged against the patient's sacrum, and both are sized and shaped so as not to obstruct x-rays taken of the hip area of the patient.

Thus, the pelvic region of the patient is retained in the desired operating position and the patient's upper body and arm on the elevated side is supported in a position to prevent the upper body from rolling to one side or the other.

It should be noted that the clamps 31 supporting the pelvic positioners 27A,27B are disposed near the head end of the operating table and provide an unobstructed area directly across from the hip area of the patient in which the operating surgeon can move freely. Thus, there are no protruding clamp knobs or levers in which the surgeon may come into bodily contact with during the operation or that might snag the surgeons clothing or gown during movement of the surgeon.

The top platform 18 covers and protects the face and upper body of the patient from accidental injury from a surgical instrument being passed over his or her face or upper body, or being accidentally dropped during the surgical procedure. The top platform 18 also serves as a convenient work surface to safely place instruments during the operation.

While this invention has been described fully and completely with special emphasis upon a preferred embodiment, it should be understood that within the scope of the appended claims the invention may be practiced otherwise than as specifically described herein.

What is claimed is:

1. An adjustable table attachment apparatus adapted for attachment to an operating table for receiving and supporting various attachments above the operating table, comprising:

a generally U-shaped tubular frame having vertical legs adapted at their lower ends to be removably received and secured on opposed sides of an operating table by clamps attached to longitudinal rails on the opposed sides of the operating table, and at least one tubular rail extending horizontally between an upper end of said legs a distance above the operating table; and a rigid generally rectangular top platform having one end adapted to be removably received and supported on said at least one horizontally-extending rail and a contiguous generally rectangular main portion extending generally horizontally outward from said at least one horizontally-extending rail when supported thereon a distance above the operating table to cover and shield a portion of the body of a patient laying on one side on the operating table and to support surgical instruments placed on said platform main portion during a surgical procedure;

said frame and tubular rail and said top platform supported thereon being adjustably positionable between a head end and a foot end of the operating table, and adjustably raised and lowered to selected positions relative to the operating table.

2. The table attachment apparatus according to claim 1, wherein said top platform has a width narrower than the distance between said legs of said frame and said one end is slidably supported on said at least one horizontally-extending rail to allow said platform to be adjustably positioned between said legs.

3. The table attachment apparatus according to claim 1, wherein said tubular frame has a tubular top rail and a tubular lower rail a short distance beneath said top rail extending horizontally between an upper end of said legs in parallel vertically spaced relation; and said one end of said platform is removably received and supported on said top rail and said lower rail and said platform generally rectangular main portion is cantilevered generally horizontally outward from said top rail.

4. The table attachment apparatus according to claim 3, wherein said one end of said platform has a longer vertical portion extending generally vertically downward from said main portion and a short horizontal portion extending a short distance inwardly in the direction of said main portion and terminating in a shorter vertical portion; and an underside of said short horizontal portion and said shorter vertical portion of said one end are engaged on a top and one side surface of said lower rail and an underside of said longer vertical portion and said main portion are engaged on a top and one side surface of said top rail.

5. An adjustable table attachment apparatus adapted for attachment to an operating table for receiving and supporting various attachments above the operating table, comprising:

a generally U-shaped tubular frame having vertical legs adapted at their lower ends to be removably received and secured on opposed sides of an operating table by clamps attached to longitudinal rails on the opposed sides of the operating table, and at least one tubular rail extending horizontally between an upper end of said legs a distance above the operating table, said frame being adjustably positionable between a head end and a foot end of the operating table, and adjustably raised and lowered relative to the operating table;

clamping means on each of said legs;

an anterior pelvic positioner attachment having an elongate tubular support rod with an anterior pelvic support member mounted at a first end and a second end of said support rod adjustably connected with said clamping means on one of said legs;

a posterior pelvic positioner attachment having an elongate tubular support rod with a posterior pelvic support member mounted at a first end and a second end of said support rod adjustably connected with said clamping means on the other one of said legs;

each said clamping means functioning to allow said anterior and said posterior pelvic support members to be independently positioned at selective distances from the respective said leg on which it is supported and to raise and lower and pivot said anterior and said posterior pelvic support members relative to each said respective leg and to the operating table and to secure said anterior and said posterior pelvic support members at said selected distances and at said selected raised and lowered and pivoted positions; whereby said anterior pelvic support member is firmly engaged on an anterior pelvic region of a patient laying on one side on the operating table, and said posterior pelvic support member is firmly engaged on a posterior pelvic region of the patient, and the patient is supported in the position laying on one side on the operating table to substantially reduce the tendency of the patient's lower body from rolling to one side or the other.

6. The table attachment apparatus according to claim 5, wherein each of said support rods is a generally L-shaped member having a longer vertical portion and a shorter portion at one end that extends outward from said elongate portion; and said anterior and said posterior pelvic support members are mounted on said shorter portion of respective said support rods by a swivel connection.

7. The table attachment apparatus according to claim 5, wherein said anterior and said posterior pelvic support members are sufficiently sized and shaped to firmly engage the anterior and posterior pelvic regions of the patient and not to significantly obstruct x-rays taken of the hip area of the patient.

8. The table attachment apparatus according to claim 7, wherein said anterior and said posterior pelvic support members are sized and shaped to be firmly engaged against the pubis and the sacrum of the patient, respectively.

9. An adjustable table attachment apparatus adapted for attachment to an operating table for receiving and supporting attachments to support and maintain a patient in a position laying on one side on the operating table, comprising:

a frame having vertical legs adapted at their lower ends to be removably received and secured on opposed sides of an operating table by table clamps attached to longitudinal rails on the opposed sides of the operating table, and at least one frame crossmember extending horizontally between an upper end of said legs a distance above the operating table;

a rigid generally rectangular top platform having one end adapted to be removably received and supported on said frame and having a main portion extending generally horizontally outward therefrom when supported thereon a distance above the operating table to cover and shield a portion of the body of a patient laying on one side on the operating table and to support surgical instruments placed on said platform main portion during a surgical procedure, said frame and said top platform supported thereon being adjustably positionable between a head end and a foot end of the operating table, and adjustably raised and lowered to selected positions relative to the operating table;

first clamping means on a first one of said legs;

an arm support attachment adjustably connected with said first clamping means to be adjustably positionable at a selective distance from said first leg and be to raised and lowered and pivoted relative to said first leg and to the operating table and to be secured at said selected distances and at said selected raised and lowered and pivoted positions, whereby the arm on the elevated side of the patient laying on one side is supported on said arm support attachment in a position to substantially reduce the tendency of the patient's upper body from rolling to one side or the other;

second clamping means on each of said legs; and an anterior pelvic positioner attachment adjustably connected with said second clamping means on one of said legs, and a posterior pelvic positioner attachment adjustably connected with said second clamping means on the other one of said legs;

said anterior and said posterior pelvic support attachments being independently positionable at selective distances from the respective said leg on which it is supported and each being raised and lowered and pivoted relative to each said respective leg and to the operating table and to be secured at said selected distances and at said selected raised and lowered and pivoted positions, whereby said anterior and said posterior pelvic support attachments are firmly engaged on a respective anterior and posterior pelvic region of the patient laying on one side to substantially reduce the tendency of the patient's lower body from rolling to one side or the other.

10. The adjustable table attachment apparatus according to claim 9, wherein said frame is a generally U-shaped tubular frame, and said frame crossmember comprises at least one tubular rail extending horizontally between an upper end of said legs a distance above the operating table; and said top platform has one end adapted to be removably received and supported on said at least one horizontally-extending rail and a contiguous generally rectangular main portion extending generally horizontally outward from said at least one horizontally-extending rail when supported thereon.

11. The adjustable table attachment apparatus according to claim 10, wherein said top platform has a width narrower than the distance between said legs of said frame and said one end is slidably supported on said at least one horizontally-extending rail to allow said platform to be adjustably positioned between said legs.

12. The adjustable table attachment apparatus according to claim 10, wherein said tubular frame has a tubular top rail and a tubular lower rail a short distance beneath said top rail extending horizontally between an upper end of said legs in parallel vertically spaced relation; and said one end of said platform is removably received and supported on said top rail and said lower rail and said platform generally rectangular main portion is cantilevered generally horizontally outward from said top rail.

13. The adjustable table attachment apparatus according to claim 12, wherein said one end of said platform has a longer vertical portion extending generally vertically downward from said main portion and a short horizontal portion extending a short distance inwardly in the direction of said main portion and terminating in a shorter vertical portion; and an underside of said short horizontal portion and said shorter vertical portion of said one end are engaged on a top and one side surface of said lower rail and an underside of said longer vertical portion and said main portion are engaged on a top and one side surface of said top rail.

14. The adjustable table attachment apparatus according to claim 9, wherein said arm support attachment comprises a rigid generally rectangular arm support member and an elongate tubular support rod extending outwardly thereof and an outer end of said support rod adjustably connected with said first clamping means to support said arm support member; and said first clamping means functioning to allow said generally rectangular arm support member to be positioned at selective distance from said at least one leg and to raise and lower and pivot said arm support member relative to said at least one leg and to the operating table and to secure said arm support member at said selected distances and at said selected raised and lowered and pivoted positions; whereby the arm on the elevated side of a patient laying on one side on the operating table is supported on said arm support member in a position to substantially reduce the tendency of the patient's upper body from rolling to one side or the other.

15. The adjustable table attachment apparatus according to claim 9, wherein said anterior pelvic positioner attachment comprises an elongate tubular support rod with an anterior pelvic support member mounted at a first end and a second end of said support rod adjustably connected with said second clamping means on one of said legs;

said posterior pelvic positioner attachment comprises an elongate tubular support rod with a posterior pelvic support member mounted at a first end and a second end of said support rod adjustably connected with said second clamping means on the other one of said legs;

said second clamping means functioning to allow said anterior and said posterior pelvic support members to be independently positioned at selective distances from the respective said leg on which it is supported and to raise and lower and pivot said anterior and said posterior pelvic support members relative to each said respective leg and to the operating table and to secure said anterior and said posterior pelvic support members at said selected distances and at said selected raised and lowered and pivoted positions; whereby said anterior pelvic support member is firmly engaged on an anterior pelvic region of a patient laying on one side on the operating table, and said posterior pelvic support member is firmly engaged on a posterior pelvic region of the patient, and the patient is supported in the position laying on one side on the operating table to substantially reduce the tendency of the patient's lower body from rolling to one side or the other.

16. The adjustable table attachment apparatus according to claim 15, wherein each of said support rods is a generally L-shaped member having a longer vertical portion and a shorter portion at one end that extends outward from said elongate portion; and said anterior and said posterior pelvic support members are mounted on said shorter portion of respective said support rods by a swivel connection.

17. The adjustable table attachment apparatus according to claim 15, wherein said anterior and said posterior pelvic support members are sufficiently sized and shaped to firmly engage the anterior and posterior pelvic regions of the patient and not to significantly obstruct x-rays taken of the hip area of the patient.

18. The adjustable table attachment apparatus according to claim 17, wherein said anterior and said posterior pelvic support members are sized and shaped to be fry engaged against the publis an the sacRm of the patient, respectively.

* * * * *